US006193637B1

(12) United States Patent
Corbin

(10) Patent No.: US 6,193,637 B1
(45) Date of Patent: Feb. 27, 2001

(54) UPPER BODY EXERCISE DEVICE

(76) Inventor: John H. Corbin, 7608 Fawn Hollow Cove, Austin, TX (US) 78750

( * ) Notice: Subject to any disclaimer, the term of this patent is extended or adjusted under 35 U.S.C. 154(b) by 0 days.

(21) Appl. No.: 09/336,797

(22) Filed: Jun. 21, 1999

(51) Int. Cl.[7] ..... A63B 21/02

(52) U.S. Cl. ..... 482/121; 482/125; 482/126; 482/148; 482/115; 446/120

(58) Field of Search ..... 482/121, 126, 482/79, 82, 115, 125, 139, 148; 446/120, 113, 103

(56) References Cited

U.S. PATENT DOCUMENTS

| | | | | |
|---|---|---|---|---|
| 1,629,209 | * | 5/1927 | Fairbanks | 482/82 |
| 2,014,293 | * | 9/1935 | Riley | 482/126 |
| 2,714,008 | | 7/1955 | Urban . | |
| 3,451,675 | * | 6/1969 | Burzenski | 482/126 |
| 3,475,023 | * | 10/1969 | Fauvelle . | |
| 4,489,937 | | 12/1984 | Kong . | |
| 5,004,226 | | 4/1991 | Brown, Jr. . | |
| 5,022,648 | | 6/1991 | Travis . | |
| 5,026,050 | | 6/1991 | Leung et al. . | |
| 5,267,929 | | 12/1993 | Chen . | |

* cited by examiner

*Primary Examiner*—Jerome W. Donnelly
*Assistant Examiner*—Lori Parker Amerson
(74) *Attorney, Agent, or Firm*—Joseph F. Long

(57) ABSTRACT

A series of open dumbbell shaped connectors, each with a male end and each with a female end, sized so that a male end may be snapped into a female end to form a series that may be connected at each to a handle, with the series having sufficient resistance to movement of the handles that forearms and wrists may be reasonably exercised to develop and maintain muscle tone by a user twisting and coiling the series.

2 Claims, 2 Drawing Sheets

UPPER BODY EXERCISE DEVICE

BACKGROUND OF THE INVENTION

There are many varied complex exercise units shown in the patent literature indicating there is a perceived need. The objectives of the subject invention include:

a light weight unit a unit that may be easily carried in a briefcase or suitcase a unit that may be easily assembled a unit that may be placed in various positions or shapes and will stay in said position or shape.

a unit particularly suited for arm, wrist and shoulder muscle and joint rehabilitation.

The major components in this invention are essentially hollow dumbbell plastic shapes with one male end and one female that with considerable force may be snapped together to make a flexible joints so that a series snapped together may be bent or shaped using the force necessary to move each joint. With a handle connected on either end of a one to two foot series of these dumbbell plastic shapes the resistance to movement of the handles is sufficient to give a reasonable work out in a few minutes. Depending upon the use smaller diameter or fewer of the dumbell shaped connectors may be used. Plastic shapes manufactured by LOC-LINE® are suitable for this use.

SUMMARY OF THE INVENTION

The invention includes three somewhat different embodiments of an exercise unit formed with hollow plastic dumbbell shaped components that have a male end and a female end with the female end being sized to forcibly snap over a male end of a separate connector. A group or series of these connectors may be forcibly snapped together and fastened at each end to a handle that may be straight or curved. A one to two foot series of the dumbbell connectors or units has sufficient resistance to movement that a one to two foot segment may be twisted and curled and bent to give a reasonable upper body exercise in a few minutes.

DETAILED DESCRIPTION OF THE INVENTION

Figure 1:
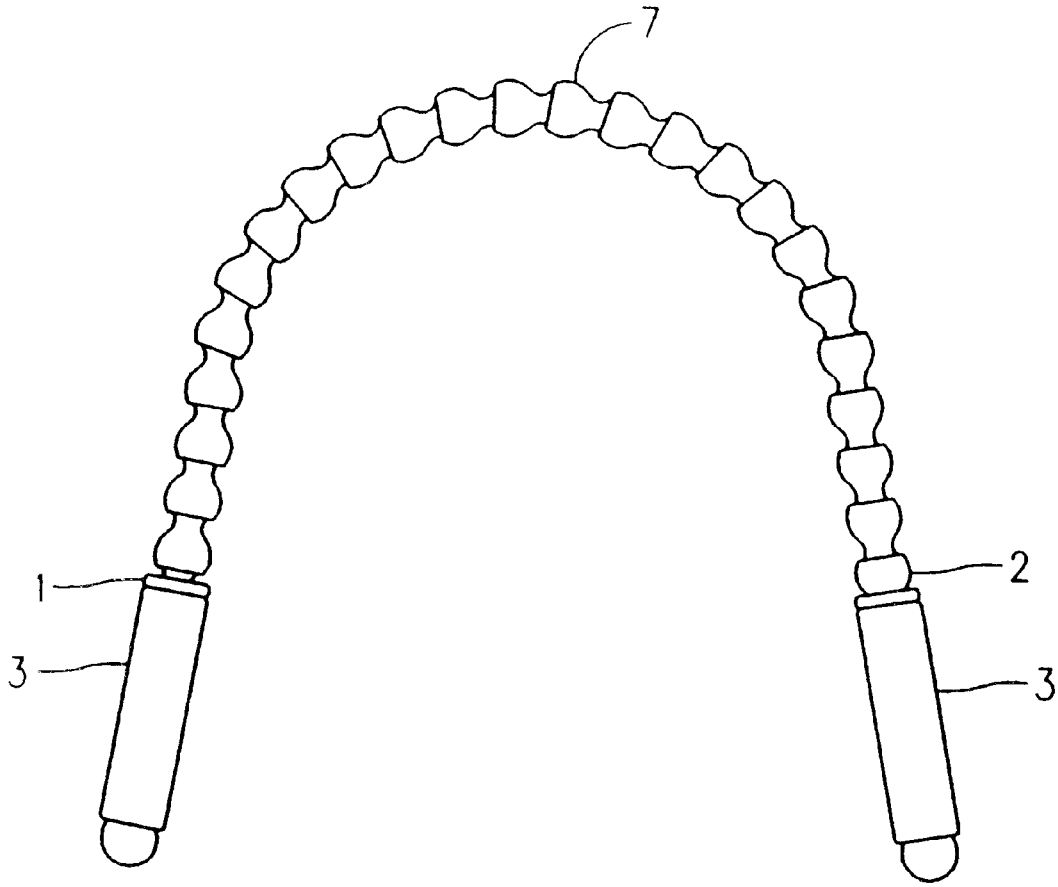
FIG. 1 preferred version of the exercise device.

The invention may best be described from the drawings. A first embodiment is shown in FIG. 1. Dual handles 3 may be plastic or wood or metal and in this embodiment both handles have threaded openings. Special male connector threaded into a single end into handle 3 may be snapped into a female end of the dumbbell shaped plastic connectors 7 and special female connector threaded on a single end into a second handle 3 may be snapped around a male end of connectors 7. The connectors 7 all snap tightly together to give forearm and upper body resistance to the handle movement.

Figure 2:
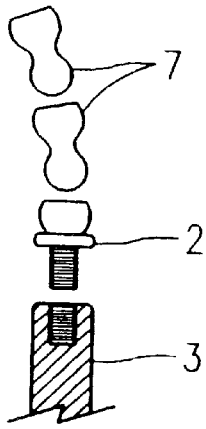
FIG. 2 a threaded male beginning end to connect a threaded single end of a male connector to a threaded handle.

FIG. 2 shows more detail of female connector 2 with one end threadable into handle 3 and the female end snappable around the dumbbell shaped connectors 7.

Figure 3:
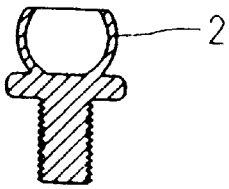
FIG. 3 a threaded female beginning end to connect a threaded single end of a female connector to a threaded handle.

FIG. 3 shows female connector 2 that may be threaded into a second handle 3 thereby allowing one end of a series of connectors 7 to be snapped into one handle and the other end of the series to be snapped into the other handle to complete the assembly of the exercise unit.

Figure 4:
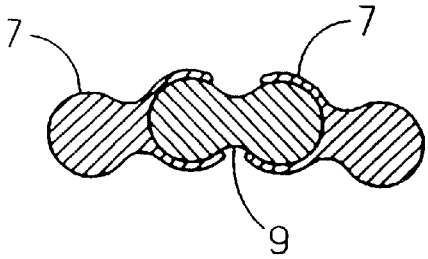
FIG. 4 a male double ended connector to use between female ends of said dumbbell connector units.

FIG. 4 shows a dumbbell type connector 9 that allows fastening the female ends of the dumbbell type connectors 7 together. Connector 9 is shown with dual male ends but obviously could be made with dual female ends in which case the series of connectors 7 would be reversed with the overall unit functioning exactly as before.

Figure 5:
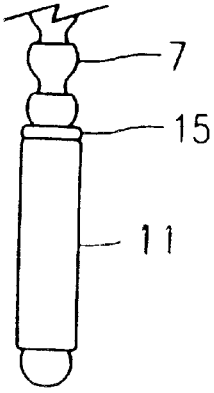
FIG. 5 shows a male end of a dumbbell connector fused to one of dual handles.
Figure 6:
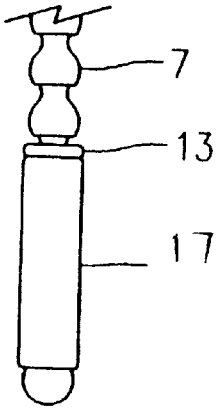
FIG. 6 shows a female end of a dumbbell connector fused to a second one of dual handles.

FIGS. 5 and 6 show a different handle for another embodiment of the exerciser unit. In FIG. 5 a female end of a connector 7 is fused to a plastic handle 11 at point 15 and in FIG. 6 a male end of a connector 7 is fused to a second plastic handle 17 at point 13. One end of a series of plastic connectors 7 may be snapped into handle 17 and the other end may be snapped into handle 11 to complete the assembly of an exercise unit.

By connecting the female ends of a series of connectors 7 together using connector 9, FIG. 4, an exerciser unit could be assembled using two handles 11, FIG. 5.

What is claimed is:

1. An upper body exercise device comprising:

a) dual handles, each with a threaded hole in a first end of each of said handles;

b) a threaded female end connector threaded into one of said threaded holes in a first one of said dual handles;

c) a threaded male end connector threaded into one of said threaded holes in a second one of said dual handles;

d) a series of open dumbbell connectors having one male end and one female end, said series formed by snapping together a multiplicity of said open dumbbell connectors;

e) a first end of said series of said dumbbell connectors snappable into said threaded male end connector and a second end of said series of said dumbbell connectors snappable into said threaded female end connector after said connectors are threaded into said handles said series of said dumbbell connectors having sufficient resistance to movement so that twisting, turning said threaded handles causes ample upper body and arm exercise.

2. An upper body exercise device comprising:

a) dual handles, each with a threaded hole in a first end of each of said handles;

b) a threaded female end connector threaded into one of said threaded holes in a first one of said dual handles; and c) a threaded female end connector threaded into one of said threaded holes in a second one of dual handles;

d) a first series of open dumbbell connectors formed by snapping a multiplicity of said open dumbbell connectors one to the other; and e) a second series of said open dumbbell connectors formed by snapping a multiplicity of said open dumbbell connectors one to the other;

f) a double male connector with a first end snappable into a first female end of said first series of said open dumbbell connectors and with a second end of said double male connector snappable into a first female end of said second series of said open dumbbell connectors; and with male ends of both said first series and said second series of dumbbell type connectors into said threaded female end connector threaded into each of said dual handles.

* * * * *